United States Patent [19]

Grosswendt et al.

[11] 4,244,293

[45] Jan. 13, 1981

[54] PROJECTILE DESIGNED FOR RECOILLESS AND VIRTUALLY NOISELESS FIRING

[75] Inventors: Werner Grosswendt, Ratingen; Manfred Moll; Wilfried Becker, both of Düsseldorf, all of Fed. Rep. of Germany

[73] Assignee: Rheinmetall GmbH, Düsseldorf, Fed. Rep. of Germany

[21] Appl. No.: 807,315

[22] Filed: Jun. 9, 1977

Related U.S. Application Data

[63] Continuation-in-part of Ser. No. 746,702, Nov. 26, 1976, abandoned.

[30] Foreign Application Priority Data

Nov. 25, 1975 [DE] Fed. Rep. of Germany ..... 2553201

[51] Int. Cl.[3] ..... F41F 3/02

[52] U.S. Cl. ..... 102/38 RL; 102/49.3; 89/1.701

[58] Field of Search ..... 102/49.1–49.8, 102/38 RL, 38 R; 89/1.7, 1.818, 1.701, 1.702, 1.703, 1.704; 239/265.15

[56] References Cited

U.S. PATENT DOCUMENTS

| | | | |
|---|---|---|---|
| 3,486,451 | 12/1969 | Moore et al. | 102/49.3 |
| 3,668,872 | 6/1972 | Camp | 239/265.15 |
| 3,677,131 | 7/1972 | Nee | 89/1.703 |
| 3,771,417 | 11/1973 | Schnabele | 102/38 RL |
| 3,779,130 | 12/1970 | Schnabele | 89/14 SB |
| 4,012,987 | 3/1977 | Burkhalter et al. | 89/1.701 |

FOREIGN PATENT DOCUMENTS

| | | | |
|---|---|---|---|
| 555659 | 3/1957 | Belgium | 89/1.701 |
| 831819 | 2/1952 | Fed. Rep. of Germany . | |
| 1740740 | 2/1957 | Fed. Rep. of Germany . | |
| 1131560 | 6/1962 | Fed. Rep. of Germany . | |
| 1287975 | 1/1969 | Fed. Rep. of Germany | 102/49.1 |
| 2004291 | 8/1971 | Fed. Rep. of Germany . | |

*Primary Examiner*—Harold J. Tudor
*Attorney, Agent, or Firm*—Montague & Ross

[57] ABSTRACT

A projectile to be fired from a tubular or rail-shaped launcher has a warhead integral with a rearwardly extending tube of smaller diameter which contains a propulsive charge inserted between the warhead and a sabot carrying a frangible inertial mass. The rear end of the tube has a constricted opening which, upon detonation of the charge, retains the rearwardly moving sabot while giving passage to the disintegrating mass as the projectile is propelled forwardly. The propulsion gases evolving within the tube are temporarily retained by one or more heat-destructible plugs in the sabot and/or in the tube which melt, burn or char to allow the delayed escape of the gases whereby an in-flight thrust is imparted to the projectile.

7 Claims, 1 Drawing Figure

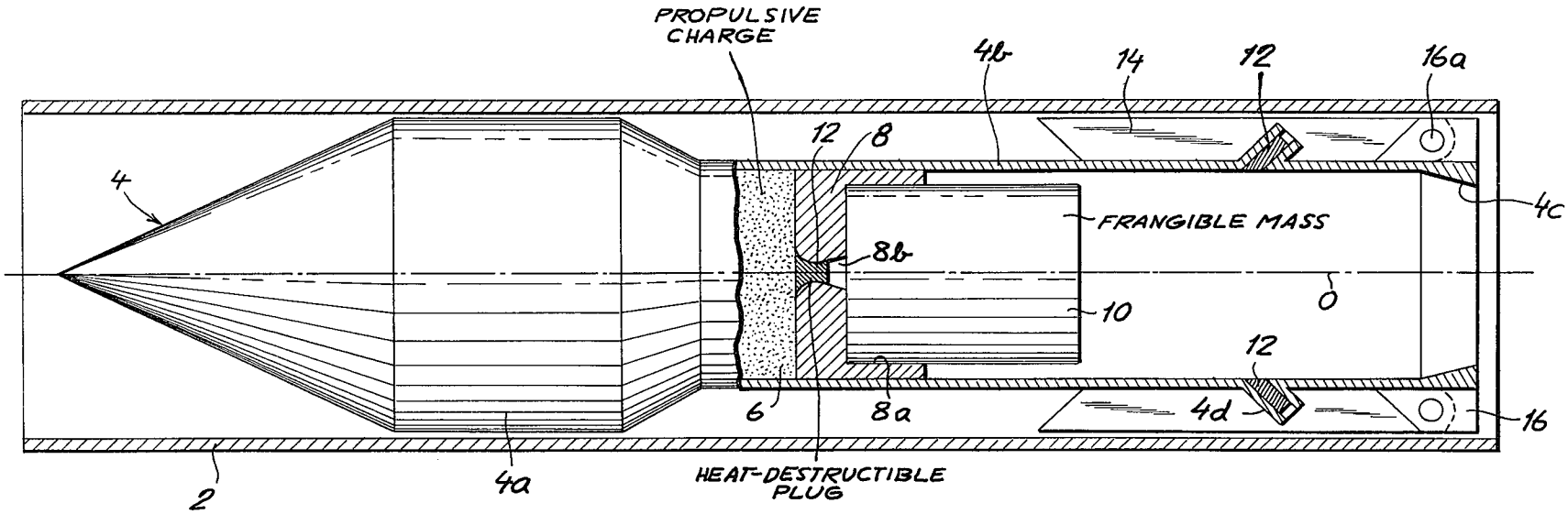
4c
16
16a
12
12
14
FRANGIBLE MASS
O
4d
10
4b
8
8b
8a
12
PROPULSIVE CHARGE
6
HEAT-DESTRUCTIBLE PLUG
4a
2
4

PROJECTILE DESIGNED FOR RECOILLESS AND VIRTUALLY NOISELESS FIRING

CROSS-REFERENCE TO RELATED APPLICATION

This application is a continuation-in-part of our copending application Ser. No. 746,702, filed Nov. 26, 1976 and now abandoned.

FIELD OF THE INVENTION

Our present invention relates to a projectile designed to be fired from a launcher, such as an open-ended tube, without recoil and with minimum noise.

BACKGROUND OF THE INVENTION

It is known, e.g. from German published specification No. 2,140,875, to assemble within an open-ended launching tube a series of elements including a projectile and an inertial mass bracketing a propulsive charge between them. The projectile and the inertial mass are provided with respective sabots which are driven apart upon detonation of the charge and are intercepted, at opposite ends of the tube, by constrictions letting the projectile and the inertial mass pass through in opposite directions. The impact of the sabots upon the constricted tube ends is reduced by interposed deformable braking rings. Upon a simultaneous interception of the two sabots, the impact is balanced so that the launcher experiences no recoil. Such simultaneity, however, is difficult to achieve in practice even if the mass of the inertial body exactly equals that of the projectile; thus, different coefficients of friction may result in consecutive rather than concurrent engagement of the end barriers by the two sabots. Other problems encountered with this type of launching system include the direct heating of the tube, especially in a succession of firings, by the combustion gases which can escape only slowly from the interior of the tube.

OBJECTS OF THE INVENTION

The general object of our present invention is to provide an improved projectile which can be fired in a recoilless and virtually noiseless manner from a simple launcher, without subjecting that launcher to mechanical impact or overheating.

Another object is to provide means in such a projectile for utilizing the residual energy of confined combustion gases to impart an in-flight thrust to the projectile after firing.

SUMMARY OF THE INVENTION

In accordance with our present invention, an inertial body more or less balancing the mass of a projectile to be fired is initially disposed within a tubular tail forming an integral part of the projectile, rather than in an external launching tube surrounding same. The inertial body, which should consist of a frangible mass disintegrating upon its discharge from the tubular tail, is separated from a projectile head by a propulsive charge whose detonation, therefore, drives the projectile and the body in opposite directions. A sabot engaging the inertial body is intercepted at a constricted rear end of the projectile tail but has a low mass compared with that of the inertial body so as not significantly to decelerate the launched projectile even as the inertial body is discharged therefrom.

Advantageously, pursuant to another feature of our invention, the sabot has a transverse wall which initially separates the inertial body from the charge and, upon interception of the sabot at the rear end of the projectile tail, defines with the peripheral wall of that tail a substantially closed chamber from which the confined combustion gases can escape only slowly, preferably through one or more rearwardly facing nozzles provided in the sabot and/or in the peripheral wall. By their delayed escape, these combustion gases exert an in-flight forward thrust upon the projectile. The development of this thrust can be positively retarded by initially blocking each nozzle with a heat-destructible plug of fusible, combustible or carbonizable material.

BRIEF DESCRIPTION OF THE DRAWING

The above and other features of our invention will now be described in detail with reference to the accompanying drawing the sole FIGURE of which shows, in axial section, a projectile according to our invention lodged in a launching tube.

SPECIFIC DESCRIPTION

As shown in the drawing, a launching tube 2 open at both ends provides guidance for a projectile 4 consisting essentially of a pointed warhead 4*a*, containing a nonillustrated explosive charge, and a tubular tail 4*b* integral with that warhead. Tail 4*b*, having a diameter which is less than that of warhead 4*a* and which therefore is separated from the tube 2 by an annular clearance, is provided with a set of wings 14 (only two shown) which are articulated to the rear end of the tail by hinge mountings 16 for swinging about pivot pins 16*a* that are skew to the tube axis O and transverse to the direction of projectile motion. The wings 14, pointing forwardly in the illustrated launching position, serve for the guidance of the projectile 4 within the launching tube 2 and swing back through an arc of 90°–180°, here shown to be about 120°, upon leaving that tube for stabilizing the flight of the projectile, as by imparting a spin to it (in which case, of course, they will have to be suitably slanted or curved).

The interior of tail 4*b* is occupied, in order, by a propulsive charge 6, a sabot 8 and an inertial body 10 seated in a rearwardly facing recess 8*a* of the sabot. Body 10, which consists of a frangible mass, clears a constriction 4*c* at the rear end of tail 4*b* which is formed by a rearwardly tapering peripheral surface and intercepts the relatively light-weight sabot 8 as it moves rearwardly with reference to projectile 4 upon detonation of the charge 6. the transverse wall of sabot 8 has a nozzle orifice 8*b* occupied by a plug 12 which burns, vaporizes or chars under the heat of the combustion gases so as to let these gases escape after a certain delay following the firing of the projectile, that delay being sufficient to carry the projectile well beyond the range in which these escaping gases would be harmful to the operator of the launcher. Instead of or in conjunction with the nozzle orifice 8*b* in sabot 8 other nozzles 4*d* on the rear end of tail 4*b*, also occupied by plugs 12, can be provided which are uncovered by the sabot engaging the constriction 4*c* and also serve to let the trapped combustion gases under high residual pressure escape in a rearward direction for exerting a forward thrust upon the projectile. As the gases do not expand into the launching tube, the firing will not be accompanied by a sharp report. Since the projectile with the hot gases quickly leaves the tube 2, the latter is not significantly heated thereby.

In conjunction with the frangible mass of body 10, reference may be made of U.S. Pat. No. 3,779,130 mentioning gritty solid substances such as sand.

From the foregoing description it will be apparent that the launcher 2 need not fulfill any tasks other than aiming the projectile and carrying the nonillustrated charge detonator. It may therefore consist of a structurally weak pipe or a simple guide rail.

It will be noted that the body 10 in its initial position, illustrated in the drawing, would block the escape path for gases evolving from charge 6 by way of nozzle orifices 8*b* and 4*d* even in the absence of plugs 12.

We claim:

1. A projectile comprising:

a head provided with a tubular tail;

a sabot slidably received in said tail;

an inertial body engaged by said sabot with clearance from the inner wall surface of said tail; and a propulsive charge in said tail inserted between said head and said sabot for driving said head and tail forwardly and said sabot and body rearwardly upon being detonated, said tail having a rear end provided with a constricted opening bounded by an inwardly tapering peripheral surface for retaining said sabot permanently in said tail while giving passage to said body, said sabot having a transverse wall interposed between said charge and said body, said transverse wall defining with the peripheral wall of said tail a substantially closed chamber for retention of combustion gases from said charge upon engagement of said sabot with said constricted opening, at least one of said walls being provided with an aperture which is occupied by a heat-destructible plug and forms a path for a delayed escape of said combustion gases from said chamber, said path being initially obstructed by said body.

2. A projectile as defined in claim 1 wherein said aperture forms a rearwardly diverging nozzle in said transverse wall.

3. A projectile as defined in claim 1 wherein said peripheral wall has a rearwardly and radially outwardly slanting nozzle forming said aperture.

4. A projectile as defined in claim 1 wherein said tail has a diameter smaller than that of said head, said tail being provided at said rear end with external wings having outer edges located along a radius equal to that of said head.

5. A projectile as defined in claim 4 wherein said wings are articulated to said rear end for swinging through an arc of 90° to 180° about pivotal axes transverse to the tube axis of said tail.

6. A projectile as defined in claim 1 wherein said sabot has a rearwardly facing recess embracing at least part of said body.

7. A projectile as defined in claim 1 wherein said body consists of a frangible mass disintegrating upon leaving said tail.

* * * * *